US005220877A

United States Patent [19]

Redovian

[11] Patent Number: 5,220,877

[45] Date of Patent: Jun. 22, 1993

[54] PRESSER FOOT LIFTER ATTACHMENT FOR SEWING MACHINE

[76] Inventor: Martin Redovian, 1185 Sierra Vista Way, Lafayette, Calif. 94549

[21] Appl. No.: 773,378

[22] Filed: Oct. 7, 1991

[51] Int. Cl.[5] ..... D05B 29/00

[52] U.S. Cl. ..... 112/237

[58] Field of Search ..... 112/237, 238, 239

[56] References Cited

U.S. PATENT DOCUMENTS

| | | | |
|---|---|---|---|
| 390,071 | 9/1888 | Eberhart | 112/239 |
| 603,988 | 5/1898 | Willcox . | |
| 621,980 | 3/1899 | Stockwell | 112/238 |
| 715,669 | 10/1902 | Klemm . | |
| 818,896 | 4/1906 | Madison . | |
| 851,427 | 4/1907 | Merrow . | |
| 1,033,997 | 7/1912 | Drake . | |
| 1,080,967 | 12/1913 | Hayes . | |
| 1,134,477 | 4/1915 | Merritt . | |
| 1,370,069 | 3/1921 | Sykes . | |
| 1,420,413 | 6/1922 | Voe . | |
| 1,950,076 | 3/1934 | Altoff | 112/237 X |
| 3,141,430 | 7/1964 | Kagiyama | 112/237 |
| 3,347,194 | 10/1967 | Hale . | |
| 3,752,100 | 8/1973 | Sharp . | |
| 3,777,686 | 12/1973 | Hage . | |
| 4,333,407 | 6/1982 | Lerch . | |
| 4,342,272 | 8/1982 | Transue et al. | 112/237 |
| 4,466,369 | 8/1984 | Dreier . | |
| 4,674,424 | 6/1987 | Shiomi . | |
| 4,676,179 | 6/1987 | Nomura . | |
| 4,706,587 | 11/1987 | Shiomi . | |

FOREIGN PATENT DOCUMENTS

| | | | |
|---|---|---|---|
| 247708 | 6/1912 | Fed. Rep. of Germany | 112/235 |
| 657040 | 2/1938 | Fed. Rep. of Germany | 112/237 |
| 1354072 | 1/1964 | France | 112/237 |
| 728850 | 4/1955 | United Kingdom | 112/237 |

*Primary Examiner*—Clifford D. Crowder
*Assistant Examiner*—Paul C. Lewis
*Attorney, Agent, or Firm*—Townsend & Townsend Khourie & Crew

[57] ABSTRACT

A pressure foot lifter mechanism is installed as an attachment on any sewing machine. In a preferred embodiment, a clamp is attached to the presser foot lifter bar of a sewing machine, and a coil spring is used to bias a cable attached to the clamp in a downward direction. The coil spring extends over and biases the presser foot lifter bar, and thereby the pressure foot, downwardly. The cable passes through a flexible tube removably attached to the outer surface of the machine. The tube extends upwardly from the coil spring, then across the horizontal body of the machine, and then downwardly to a hole in the table top of the machine. A washer or flange is placed over the hole in the table top. The tube which carries the cable is removably attached at several locations to the sewing machine. When pressure is applied to a foot pedal, a cable tension will increase and the end of the cable attached to the pressure foot lifter bar will lift the presser foot from the table. The material to be sewn is then placed under the pressure foot with both hands. When foot pressure is released, the presser foot is lowered due to action of the coil spring.

24 Claims, 2 Drawing Sheets

PRESSER FOOT LIFTER ATTACHMENT FOR SEWING MACHINE

This invention relates to improvement in sewing machines and, more particularly, to an attachment for a presser foot lifter of a sewing machine of conventional construction.

BACKGROUND OF THE INVENTION

Every sewing machine has a presser foot lifter mechanism. The most common type is a simple cam lever on a pivot rod. When the lever is pushed upwardly by hand, the cam section slides under another rod secured to a spring-loaded pressure bar with a presser foot secured to the bottom of the bar. This action causes the presser foot to rise. There is a flat spot on the cam type lever. When it is in the raised position, the presser foot rests in the upper position until this lever is again pushed downwardly by hand.

A number of mechanisms are known in the prior art for lifting the presser foot on sewing machines by movement of the foot or by the knee. These mechanisms are a series of levers and pivot points permanently built into or onto the machines, and are mostly on the industrial type machines used in garment making factories.

There is some art covering this type of presser foot lifter mechanisms for use on household sewing machines. Such mechanism operate on a presser foot with a series of levers and pivot points within the sewing machines. Examples of such mechanisms are found in U.S. Pat. Nos. 4,333,407, 4,466,369, 603,988 and 1,370,069.

In the latter two patents, a series of cables, levers, brackets and pivot points are permanently built into or onto the sewing machine and are operated by foot or by knee movements. The structures of these patents eliminate the need for the simple cam type lever and pivot screw presser foot lifter mechanism. U.S. Pat. No. 603,988 covers a complete sewing machine. The presser foot bar mechanism is just one phase of the complete sewing machine.

During sewing with conventional sewing machines, there are times when a sewer wishes that he or she had a third hand. When the fabrics or materials being put together have to be placed under the presser foot in a precise manner, the material must be held with both hands. Some materials, if not held with both hands, will slip out of proper alignment and will not be sewed correctly.

During machine embroidery, for instance, the material is held in a darning hoop and held with both hands during sewing. At times, it is desirable to move the hoop to a different location. It would be more advantageous to have a device to lift the presser foot so that the work (hoop) could be held with both hands and moved. Rather than hold the hoop in place with one hand and use the other hand to lift the presser foot and reach back down to the hoop with both hands, the sewer must move the hoop to the next area of work but again let go of the hoop to reach up to the presser foot lifter and move the presser foot back down to start embroidering again.

The above problem presents a need for improvement in presser foot lifter mechanisms, especially as applied to household sewing machines.

SUMMARY OF THE INVENTION

The present invention is directed to a presser foot lifter mechanism that can be easily installed as an attachment on any sewing machine of any type. Installation of the attachment on a sewing machine could be accomplished by the user of the machine, and no special skills are necessary to install the attachment on the sewing machine. The attachment could be easily removed from the sewing machine without marking or defacing the sewing machine. The attachment can be placed once again on the machine for use when required.

Quilters would find the attachment especially suitable for use in making quilts. Any quilter could put the attachment on a sewing machine with little effort.

The present invention could also allow some sewers who supplement their income by sewing. Low income sewers who could not afford the cost of an expensive sewing machine could obtain and install the attachment of the present invention at modest cost.

The presser foot lifter attachment could operate to raise the presser foot by foot pressure so that material to be sewed can be placed under the presser foot with both hands exactly at a correct location and aligned to provide the proper stitching exactly as required.

In a preferred embodiment of the invention, a clamp is attached to the presser foot lifter bar of a sewing machine, and a coil spring is used to bias a cable attached to the clamp in a downward direction. Because the cable is clamped to the presser foot lifter bar on the sewing machine, the coil spring extends over and biases the presser foot lifter bar, and thereby the presser foot downwardly.

On a conventional flat bed sewing machine, the cable typically passes through a flexible tube removably attached to the outer surface of the machine. The tube extends upwardly from the coil spring, then across the horizontal body of the sewing machine, and then downwardly to a hole in the table top of the machine. On a portable or open arm sewing machine, a washer or flange is placed over a hole in the table top of the cabinet used to support the sewing machine. The hole could be at a location on the right or left side of the sewing machine either in front or at the rear. Selection of this location depends upon the user of the invention, i.e., whether it would be used for foot pressure, knee pressure or body pressure, such as of a handicapped person who would use his body by shifting his body weight to activate the presser foot lifting action.

The tube which carries the cable is preferably attached at several locations to the sewing machine by such attachment devices as Cord Control, a product of Velcro, clips by Cableways and wire ties by Ico-Rally. Even duct tape or electrical tape would be used. By placing these devices over the flexible tube at several places along the tube, the cable is kept from being crimped.

When pressure is applied to the foot pedal, the cable tension will increase and the end of the cable attached to the presser foot lifter bar will lift the presser foot from the feed. The material to be sewn is then placed under the presser foot with both hands. When foot pressure is released, the presser foot is lowered due to action of the coil spring. The spring could be part of the attachment or it could be a spring built into the presser bar mechanism already in the sewing machine.

The primary object of this invention is to provide an attachment for a presser foot lifter for mounting on the outer surface of a sewing machine to allow foot, knee or body pressure to be applied as tension to a cable coupled to a presser foot lifter bar to lift the presser foot so as to free both hands for handling material to be sewed.

Another object of the present invention is to provide an attachment of the type described wherein the attachment includes a tube removably mounted on the outer surface of the machine for shiftably mounting the cable, whereby the attachment can be installed on the machine quickly and with no special skill on the part of the person installing the attachment.

Other objects of this invention will become apparent as the following specification progresses, reference being had to the accompanying drawing for a schematic view of the invention.

DESCRIPTION OF THE PREFERRED EMBODIMENT

Figure 2:
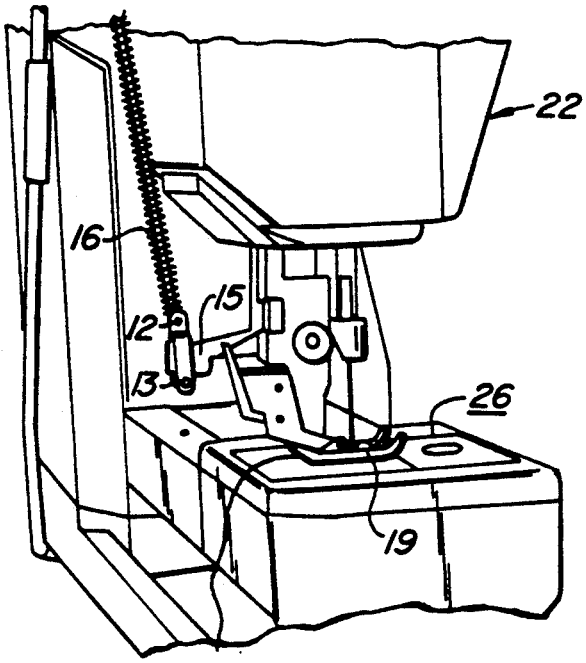
FIG. 2 is a perspective view of a portion of a sewing machine and a portion of the pressure foot lifter attachment of FIG. 1 showing the presser foot lifter bad in the lowered position.
Figure 3A:
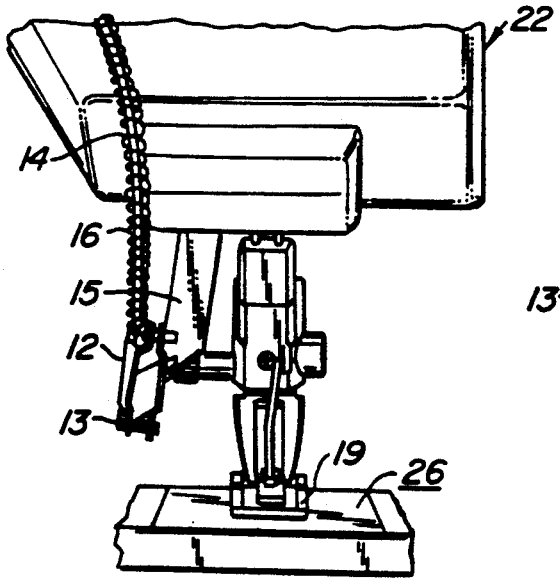
FIGS. 3A and 3B are front views of the attachment of FIG. 2 in lowered and raised positions, respectively.
Figure 3B:
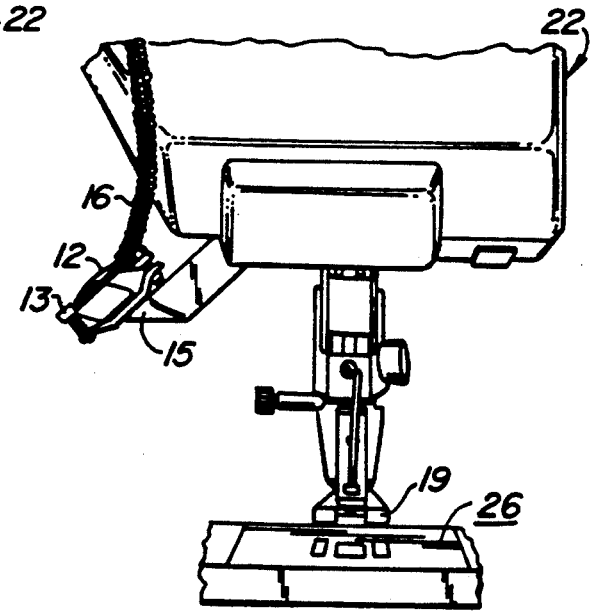

The attachment which is subject matter of the present invention is broadly denoted by the numeral 10 and includes a clamp 12 secured to one end of a flexible cord or cable 14 which extends through a coil spring 16 at the end near clamp 12. The coil spring receives the end of the cable. One end of the coil spring is attached to the clamp (see FIGS. 2, 3A and 3B) and the opposite end of the spring bears against a flange 18 at the adjacent end of a flexible tube 20 (see FIG. 1) which is removably attached in some suitable manner, such as by Velcro material 23, to the outer surface of the head 22 of a sewing machine 25 at several locations thereon. The opposite end of flexible tube 20 has a flange 24 which bears against the upper surface 26 of a table or stand 28 forming part of the bed 31 of sewing machine 25. The flexible cord or cable 14 extends through a hole 30 in table 28 and extends downwardly and is connected to a cable tensioning device, such as, in the preferred embodiment a foot pedal 32 having a hinge pin 34 for mounting the pedal to a base plate 36 which rests upon a floor surface 38 below the machine 25.

Another example of a cable tensioning device might be a knee-engageable member adapted to apply tension to the cable 14 upon the movement of the knee of a user.

Clamp 12 is secured by a screw 13 to the lower end of a presser foot lifter bar 15 which is coupled to a presser foot lifter 17 (see FIG. 1) having a foot 19 for pressing material to be sewed onto the upper surface 26 of head 22. The coil spring 16 is normally under compression and, since tube 20 is fixed to the outer surface of head 22, the spring is further compressed when clamp 12 is lifted by cable 14 (see FIG. 3B) when the tension in the cable is caused to increase when downward pressure is exerted on pedal 32, moving the pedal in a counterclockwise sense when viewing FIG. 1.

The cable 14 is passed through table 28 by first drilling a hole in the table, such as a 3/32 inch hole and then forcing the cable through the hole. This hole could be at the left hand side of the sewing machine either in the front or at the rear of the machine. The location of the hole depends upon the user's convenience, whether the attachment 10 is to be used with foot pressure, knee pressure or body pressure, such as that of a handicapped person who may use his or her body by shifting the body to activate the cable tensioning action. Tube 20 can be removably attached to the sewing machine by such other items identified as Cord Control devices, a product of Velcro Corporation, clips by Cableways and wire ties by Ico-Rally. Duct tape or electrical tape would be used to secure the tube 20 to the outside surface of machine 22. Also, no special skills are required to secure attachment 10 in place on head 22.

Figure 1:
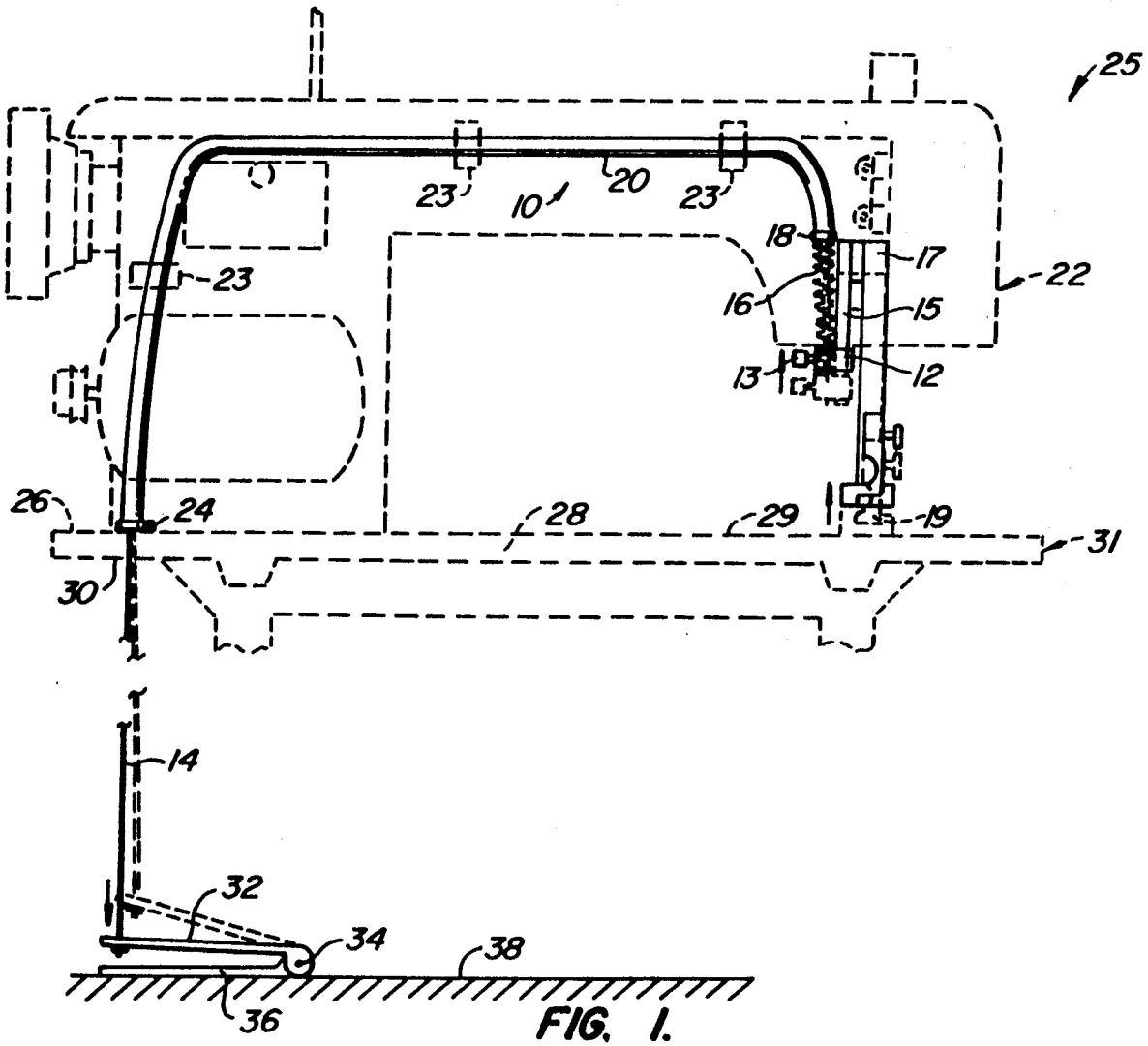
FIG. 1 is a simplified overall view of a pressure foot lifter attachment shown mounted to a sewing machine.

As shown in the FIG. 1, attachment devices 23 are provided at three locations along the length of tube 20. By placing the devices 23 over tube 20, the devices can be used to anchor the tube without crimping the tube or the cable shiftably mounted in the tube. On many cast iron sewing machines, a magnet could be used to hold the tube 20 in place, assuming the tube is made of a suitable metal.

In use, when pressure is applied to foot pedal 32, for instance, the end of the cable near presser foot lifter bar 17 will lift to, in turn, lift the presser foot lifter 15 and the presser foot 19 coupled with lifter 15. The material to be sewn can then be handled with both hands. When pressure is released from the pedal 32, the presser foot 19 is lowered due to the expansion of the spring 16 pressing against flange 18 and presser foot lifter bar 15.

On older models of machine 25, an internal spring biases the presser foot 19 downwardly. That is, once the user releases the presser foot lifter bar, the presser foot is immediately pushed downwardly since older machines may not have camming elements to stabilize the presser foot in an open position; therefore no camming surface force needs to be overcome. In such a case, the clamp 12 can be coupled directly to presser bar 17 to avoid the need for spring 16.

Other modifications and variations can be made to the disclosed embodiment without departing from the subject of the invention as defined in the following claims.

What is claimed:

1. An attachment for a sewing machine having an outer surface, a table surface, a presser foot and a presser foot lifter bar coupled with the presser foot comprising:

a cable having first and second ends and provided with securing means at said second end thereof for attaching the cable to the presser foot lifter bar of the machine;

means for removably mounting the cable on the outer surface of the machine for movement of the cable with respect thereto;

means for biasing said second end of the cable in a direction to force the presser foot towards the surface of the table, said biasing means including a coil spring having upper and lower ends and surrounding said second end of said cable; and means, coupled with said first end of the cable and mounted for placement beneath the table surface, for shifting the cable relative to the machine and said mounting means.

2. An attachment as set forth in claim 1, wherein said coil spring is under compression.

3. An attachment as set forth in claim 1, wherein said cable extends through said coil spring, there being abutments engageable with the ends of the coil spring to compress the spring as the cable moves in a direction to lift said presser foot relative to the table surface.

4. An attachment as set forth in claim 1, wherein said securing means includes a clamp connected to the presser foot lifter bar, said second end of the cable connected to the clamp.

5. An attachment as set forth in claim 4, wherein said clamp is connected to said presser foot lifter bar with a set screw and said second end of said cable is connected to said clamp with a set screw.

6. An attachment as set forth in claim 1, wherein said cable mounting means includes a flexible tube, and means for securing the tube to the outer surface of the machine.

7. An attachment as set forth in claim 1, wherein said cable mounting means includes a number of attachment pads.

8. An attachment as set forth in claim 7, wherein said attachment pads include adhesive tape.

9. An attachment as set forth in claim 1, wherein said cable mounting means includes a flexible tube, said tube having a pair of opposed ends, each of said ends having a flange thereon.

10. An attachment as set forth in claim 9, wherein one end flange of the tube engages the spring and the other end flange of the tube is for engaging the table surface.

11. An attachment as set forth in claim 8, wherein said table surface has a hole therethrough for receiving the cable, the flange on the opposite end of the tube being engageable with the tabletop in surrounding relationship to the hole in the table surface.

12. An attachment as set forth in claim 1, wherein said shifting means includes a pair of relatively shiftable members.

13. An attachment as set forth in claim 12, wherein one of the members is a foot pedal.

14. An attachment as set forth in claim 12, wherein one of the members is movable in response to a shifting of the weight of a user.

15. An attachment for a sewing machine having an outer surface, a table surface, a presser foot and a presser foot lifter bar coupled with the presser foot comprising:

a cable having first and second ends and provided with a clamp at said second end thereof for attaching the cable to the presser foot lifter bar of the machine;

a flexible tube shiftably receiving the cable and including means for mounting the tube on the outer surface of the machine to allow movement of the cable with respect to the machine;

a coil spring biasing said second end of the cable in a direction to force the presser foot toward the surface of the table; and a foot pedal connected to the first end of the cable and placeable beneath the table surface for shifting the cable relative to the machine and said tube.

16. An attachment as set forth in claim 15, wherein said cable mounting means includes a number of attachment pads.

17. An attachment as set forth in claim 16, wherein said attachment pads include adhesive tape.

18. An attachment for a sewing machine having a presser foot coupled to a presser foot lifter bar, the presser foot lifter bar being movable between raised and lowered stable positions, the attachment comprising:

a user operated actuator;

a cable having first and second ends, the first end secured to the presser foot lifter bar and the second end connected to the actuator;

means for guiding the cable along a path from the actuator to the presser foot lifter bar; and a compression spring having first and second ends positioned over the cable, there being abutments engageable with said ends of said spring to compress the spring as said presser foot lifter bar moves from the lowered position to the raised position;

said actuator including means for pulling the cable through the guiding means to move the presser foot lifter bar from the lowered position to the raised position while compressing said compression spring between said abutments, and whereby releasing said pulling means allows the compression spring to pull the cable back through the guiding means and to move the presser foot lifter bar from the raised position to the lowered position.

19. The attachment of claim 18 wherein the pulling means includes a foot pedal.

20. An attachment of claim 18 wherein the guiding means includes a hollow flexible tube.

21. An attachment for a sewing machine having an outer surface, a table surface, a presser foot and a presser foot lifter bar coupled with the presser foot comprising:

a cable having first and second ends and provided with securing means at said second end thereof for attaching the cable to the presser foot lifter bar of the machine;

means for removably mounting the cable on the outer surface of the machine for movement of the cable with respect thereto;

means for biasing said second end of the cable in a direction to force the presser foot towards the surface of the table, said biasing means including a coil spring having upper and lower ends and surrounding said second end of said cable, said cable extending through said coil spring, there being abutments engageable with said ends of said spring to compress the spring as the cable moves in a direction to lift said presser foot relative to the table surface;

means, coupled with said first end of the cable and mounted for placement beneath the table surface, for shifting the cable relative to the machine and said mounting means; and an abutment engageable with said upper end of said coil spring to compress the spring as the cable moves in a direction to lift said presser foot relative to the table surface.

22. An attachment for a sewing machine having an outer surface, a table surface, a presser foot and a presser foot lifter bar coupled with the presser foot comprising:

a cable having first and second ends and provided with securing means at said second end thereof for attaching the cable to the presser foot lifter bar of the machine;

means for removably mounting the cable on the outer surface of the machine for movement of the cable with respect thereto, said cable mounting means including a number of attachment pads;

means for biasing said second end of the cable in a direction to force the presser foot towards the surface of the table; and means, coupled with said first end of the cable and mounted for placement beneath the table surface, for shifting the cable relative to the machine and said mounting means.

23. An attachment for a sewing machine having an outer surface, a table surface, a presser foot and a presser foot lifter bar coupled with the presser foot comprising:

a cable having first and second ends and provided with securing means at said second end thereof for attaching the cable to the presser foot lifter bar of the machine;

means for removably mounting the cable on the outer surface of the machine for movement of the cable with respect thereto;

means for biasing said second end of the cable in a direction to force the presser foot towards the surface of the table; and means, coupled with said first end of the cable and mounted for placement beneath the table surface, for shifting the cable relative to the machine and said mounting means, said shifting means including a pair of relatively shiftable members, one of the members being a foot pedal.

24. An attachment for a sewing machine having an outer surface, a table surface, a presser foot and a presser foot lifter bar coupled with the presser foot comprising:

a cable having first and second ends and provided with securing means at said second end thereof for attaching the cable to the presser foot lifter bar of the machine;

means for removably mounting the cable on the outer surface of the machine to allow movement of the cable with respect to the machine;

said removably mounting means including a flexible tube surrounding said cable and having a pair of opposed ends, each of said ends having a flange thereon;

means for biasing said second end of the cable in a direction to force the presser foot towards the surface of the table; and means, coupled with said first end of the cable and mounted for placement beneath the table surface, for shifting the cable relative to the machine and said mounting means.

* * * * *